United States Patent [19]

Yoshihara

[11] Patent Number: 4,698,847

[45] Date of Patent: Oct. 13, 1987

[54] APPAREL STRUCTURE AND PROCESS FOR MAKING APPAREL

[76] Inventor: Hiroshi Yoshihara, 27-10, Minamidai 3-chome, Nakano-ku, Tokyo 164, Japan

[21] Appl. No.: 893,560

[22] PCT Filed: Nov. 21, 1985

[86] PCT No.: PCT/JP85/00645

§ 371 Date: Jul. 21, 1986

§ 102(e) Date: Jul. 21, 1986

[87] PCT Pub. No.: WO86/03103

PCT Pub. Date: Jun. 5, 1986

[30] Foreign Application Priority Data

Nov. 22, 1984 [JP] Japan ..... 59-247595
Apr. 9, 1985 [JP] Japan ..... 60-73578

[51] Int. Cl.[4] ..... A41B 9/04

[52] U.S. Cl. ..... 2/069; 2/67; 2/78 R; 2/406; 450/7; 450/100

[58] Field of Search ..... 2/69, 67, 406, 78 R, 2/78 A, 78 C, 78 B, 78 D; 128/431, 446, 524

[56] References Cited

U.S. PATENT DOCUMENTS

| | | | |
|---|---|---|---|
| 1,890,507 | 12/1932 | Gifford | 2/67 X |
| 1,962,984 | 6/1934 | Crego | 2/67 |
| 2,022,621 | 11/1935 | Ide | 2/67 |
| 2,344,674 | 3/1944 | Brown | 2/78 B |
| 2,429,767 | 10/1947 | Oliensis | 128/431 |
| 3,524,449 | 8/1970 | Peters | 128/524 |
| 4,400,832 | 8/1983 | Kinder | 2/406 |

*Primary Examiner*—Ronald Feldbaum
*Assistant Examiner*—Judith L. Olds
*Attorney, Agent, or Firm*—Jordan and Hamburg

[57] ABSTRACT

An apparel structure based on the movement of muscles during movement of the body, and a process for making such apparel, includes an apparel structure constructed to be comfortable and to have excellent adaptability to movement without tension or slack. It also provides excellent shaping-up effect, can be applied to various kinds of apparel and is particularly suitable for female underwear and shaping-up wear. It is suitable particularly for working wear, sportswear, leisure wear, etc., in which the extent of movement of the body is large, irrespective of male or female.

17 Claims, 35 Drawing Figures

(a)

(b)

(c)

(a)

(b)

(c)

(a)

(b)

(C)

(d)

(a)

(b)

(c)

(d)

(a)

(b)

(a)

(b)

(a)

(b)

APPAREL STRUCTURE AND PROCESS FOR MAKING APPAREL

TECHNICAL FIELD

The present invention relates to an apparel structure which is comfortable and which has good adaptability to movement, which causes neither tension nor slack, and to a process for making an apparel having such a structure in a simple manner. The apparel structure exhibits an excellent body shaping-up effect, and is applicable to various kinds of apparel. Although it is particularly suitable for female underwear and body shaping-up wear, it is also suitable for working wear, sportswear, and leisure wear to be adapted to extensive body movements irrespective of female or male wear.

BACKGROUND ART

In making apparel, the so-called draping has heretofore been adopted. In this case, the human body measurement is conducted according to a system of coordinates including the ordinate and abscissa of the body surface of a human body (see, for example, a "Shinpen: Hifuku to Jintai" edited by Nippon Ningen Kagakukai, Ifuku Bukai, 1983's Edition, pp. 162–167; and "Hifuku Kagaku Soron" edited by Nippon Seni Kikai Gakkai, Hifukugaku Taikeika Bunkakai, Vol. 1, pp. 69–78). The extent of movement is measured in terms of the extent of changes in the ordinate and the abscissa. In making apparel, an increased amount of material is used or a stretch material is used in part with consideration given to the extent of changes. These methods cause slack in the apparel. The apparel fixing mode, namely the mode of fixing the apparel to the body, is based on a stationary body, and is a so-called crosswise (annular) fixing mode of effecting fixation in both the vertical and horizontal directions, which utilizes hooking on the shoulder or the pelvis, or fastening or tying with an elastic cord, a string, a sash, a belt, or the like.

Various kinds of underwear and body shaping-up wear have heretofore been devised with a view to correcting the proportion of a female and preventing the breasts or buttocks from getting out of shape. They are represented by a brassiere, a corset, a girdle, a body suit, etc. The literature disclosing them includes Japanese Utility Model Registration Laid-Open Nos. 164,331/1978, 106,604/1980, 179,824/1979, 81,913/1981, and 98,810/1981; and Japanese Patent Laid-Open No. 79,702/1981. Those disclosed therein are made based on ideas analogous to that mentioned above, and have a structure based on the crosswise fixing mode.

Conventional apparel has the standard of its design based on the measurement method using the ordinate and the abscissa of the surface of a stationary body, and is essentially based on the crosswise fixing mode which is lacking in flexibility even when consideration is given to the extent of changes caused by movement. The crosswise (annular) fixing model is liable to cause inconveniences in twisting and slanting movements of a human body though it may not be so bad for the forward, backward, leftward, and rightward movements of the body. For example, conventional apparel as mentioned above is liable to cause tension on one side of the body while causing slack on its counterpart. In the case of body shaping-up wear, there have been widely employed a method comprising inserting preliminarily prepared "patterns" made of wire or plastic into the bust, waist, and hip portions, and a method comprising "fastening" crosswise, or in annular form, for example, with a stretchable elastic rubber material. These body shaping-up methods and apparel structures are based on a judgement of the effect of correction only in a state of a stationary body without consideration being given to body movement. Since they are thus not based on the arrangement and movement of muscles, an adverse effect, in fact, appears without the body shaping-effect particularly in a state of movement because of such arrangements are liable to unnatural deformation of the body, trust into a fastened portion of the body, etc. A prolonged use of such an apparel (particularly a body shaping-up wear) is occasionally liable to entail poor blood circulation, subcutaneous affluxion, muscular depression, physique deterioration, etc. The mode of fixing an apparel to a body has important functions influential on not only the apparel structure but also various functionalities and performance characteristics which the apparel should have. The crosswise fixing mode is deficient as regards the aspect of movement and cannot be adapted to movements of the human body, particularly to joint muscular movements. Further, it is poor in providing a body shaping-up function and performance.

For the purpose of solving these problems, expectation is put on the development of a "desirable apparel pattern based on the structure of movement of a human body". It involves a study on an apparel pattern adapted to the characteristics of the human body viewed in an aspect of observation as mentioned below an establishment of an adequate mode of fixing the apparel to the human body (fixing mode) and a structure therefor through physiological and kinetophysiological observation of the human body.

On the basis of such an idea, we previously established a fixing mode (fixing structure) characterized by fixing two or more mutually confronting fixing points of a human body by means of a stretchable core belt in appropriate and continuous association of the points not only in a stationary state but also in a moving state to simply and dynamically support swaying portions such as breasts, buttocks, and an abdomen. We further developed the mode into an apparel pattern, and devised a female apparel, and utility model registration applications thereof were then filed (see Japanese Utility Model Laid-Open Nos. 5,406/1982 and 5,407/1982). In this device, not only is fixation of two or more points in association with each other very effective, but also even a body shaping-up effect was confirmed. However, the effects were not perfectly satisfactory yet. More specifically, in this device, the position of the stretchable belt and the movement of the body hardly concurrent with each other because the fixing portions or the fixing points are continuously connected with each other by using the stretchable belt in an incomplete manner for lack of recognition to the effect that the basic movement of the body is based on muscular movement and as to how this is correlated with the apparel fixing mode. In other words, there is a lack in recognition as to the correlation between the group of muscles and the fixing mode. Also it was found that very complicated work is involved in sewing the stretchable core belt in an actual apparel. Since the core belt is stretchable and the surface cloth is also stretchable, a technically very difficult effort is involved in sewing the former in the latter without deviation. Particularly in a curved portion, unnatural curved sewing is involved since the core belt is originally straight. Further, an adverse effect is encountered unless the core belt is sewed in the apparel in a correct position in a uniform and non-stretched state of the core belt.

DISCLOSURE OF INVENTION

The human body works in association of the highly and finely combined muscular group with the skeletal group by way of a conjoint system in a state of movement from the standpoint of structure and performance. Moreover, in movement, fulcura association with the movement are also flexibly transferred to transfer the centroid of the whole body for securing balance. In constructing an apparel, caution is required to avoid losing these essentials associated with the structure and performance of the human body.

Specifically, since the motion of the human body is based on the work of muscles, it is desired that the fixing structure of apparel be set in accordance with the location of muscles and the direction of work of the muscles (direction of musclar stretching or contraction, or tension) in a wearing state, while the fixing mode is not a simple annular one but a joint fixing mode using three or more symmetrical or confronting fixing portions associated with one another (see, for example, "Shinpen Hifuku to Jintai" edited by Nippon Ningen Kogaku Kai, Ifuku Bukai, 1983 edition, page 87, FIGS. 2–45). The effect of the joint fixing mode becomes much more notable when the fixing portions concurring with at least three or more symmetrical or confronting locations of muscles are associated with each other. Although three or more locations are not always needed, it is desirable that portions concurring with at least two different muscular locations or work directions be associated with each other.

Accordingly, the apparel structure of the present invention is constructed in such a way as to provide a portion having a stretchable structure so constituted as to stretch or contract in concurrence with the direction of work of muscles of the human body in a wearing state for allowing the apparel to stretch or contract in accordance with the movement of the human body, by which portion the apparel is naturally and jointly fixed to the body.

In order to manufacture apparel having such a structure, a design allowing a core belt to be simply sewn in the apparent with neither stretching nor contraction is necessitated.

In view of this, the process for making an apparel according to the present invention comprises sewing a core material cut from one piece of a stretchable cloth in such a way as to run along a muscular portion of the body and/or the proximity of a muscular portion of the body in a surface cloth constituting the external appearance of the apparel in an unfolded state, and finishing the resulting composite into an apparel pattern. Thus, the core material can be simply sewn in the surface cloth without the need of adjustment of stretching or contraction of the core material.

The terms "fixing", "fixing mode", "fixing portion", and "joint fixing mode" mentioned in the present invention will now be explained.

Fixing is to fix or wear the apparel on one's body, and a fixing mode is a method therefor.

A fixing portion is a portion or point where there is close contact (wearability) of an apparel with the body, and a location serving to allow the apparel to stay on the body. It may be either wide or narrow in area.

Conjoint fixing (conjoint fixing mode) is to provide a continuous state such that the respective fixing portions are affected by the movement of fixing portions located at different portions of the body.

The principal muscles of the body and the directions of their work will now be described with reference to FIG. 7. The numeral 1 indicates musculus trapezius running along the neck from the side of the back, 2 musculus pectolaris major running from the shoulder joint to the breast, 3 musculus obliquus externus abdominis running from the flank to the crotch, 4 musculus latissimus dorsi running from the middle of the back to the side of the breast, and 5 musculus gluteus maximus running in the buttock. The working direction of each muscle is as indicated by the arrow. The musculus trapezius 1 is associated, together with scalenus, with movement of the neck and the arm. Thus, when an apparel is to be fixed to the shoulder or the neck, the form of the apparel is desired to be adapted to the working direction of this muscle. The musculus pectoralis 2 is associated, together with the musculus latissimus dorsi 4, with movement of the arm or like, and hence has a close relation with the movement of the breast. The musculus obliquus externus abdominis 3 is associated, together with musculus obliquus internus abdominis, musculus rectus abdominis, or the like, with the movement of the leg or the waist, or the forward or backward bending of the body. In order to smooth the movement of the leg or the waist, it is important to adapt the form of an apparel to the direction of work of this muscle. The musculus latissimus dorsi 4 is closely associated, together with the musculus pectolaris major 2, with the movement of the bust including throwing out or folding the chest, and located in the middle portion of the back. The musculus gluteus maximus 5 is associated, together with musculus psoas major, with the movement of the buttock or the thigh, and hence takes a particularly important role in supporting or securing the balance of movement. This group of muscles is associated and connected with the skeleton via joints to work.

BEST MODE FOR CARRYING OUT THE INVENTION

EXAMPLE 1

Figure 1:
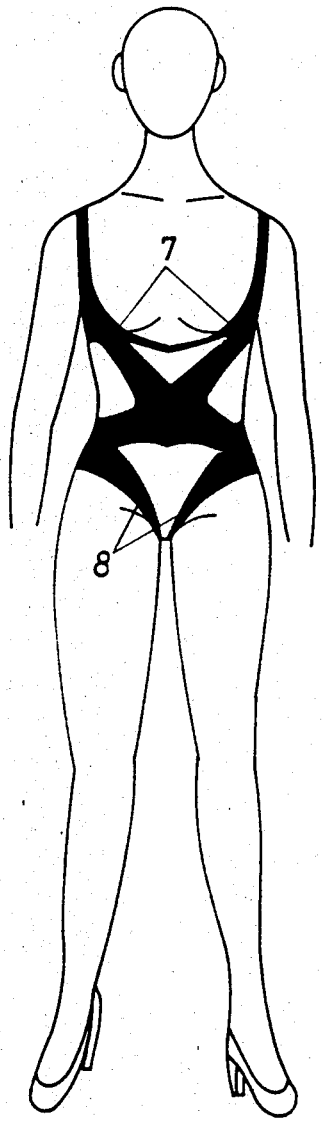
FIGS. 1 to 6 respectively show examples of apparel structures according to the present invention.
Figure 1:
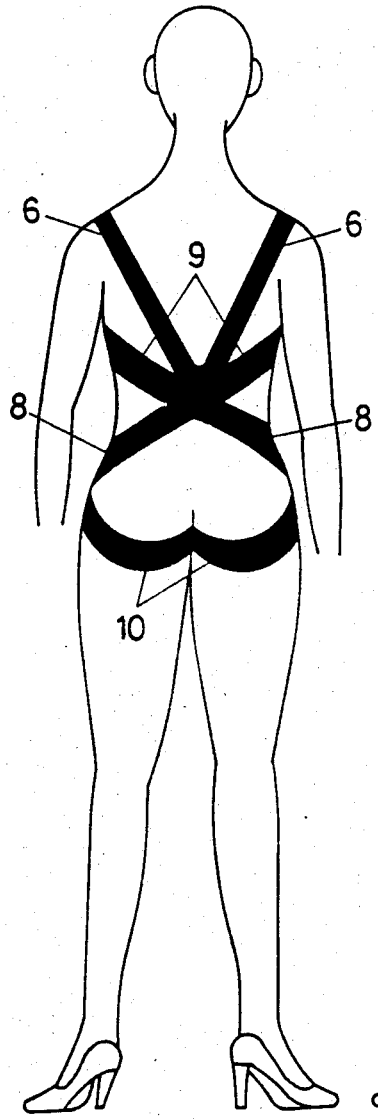
Figure 1:
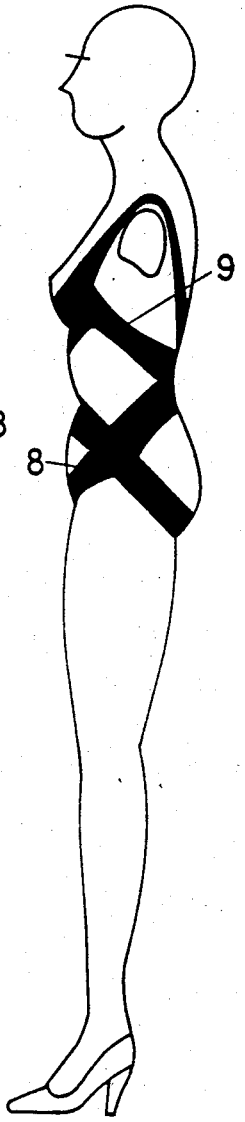
Figure 2:
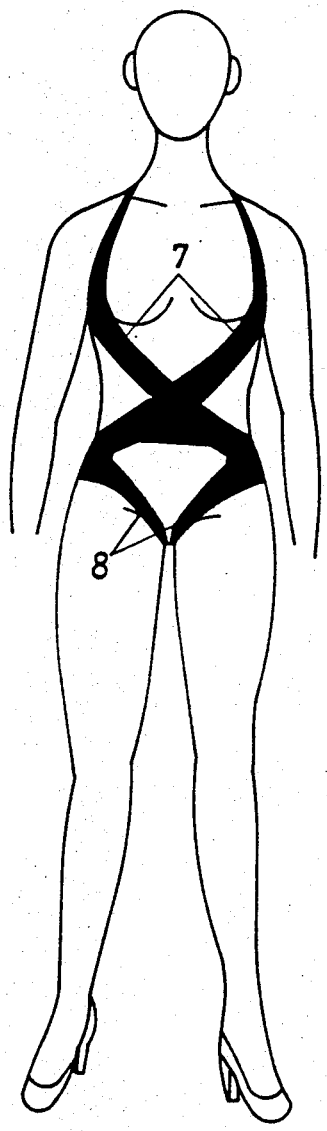
Figure 2:
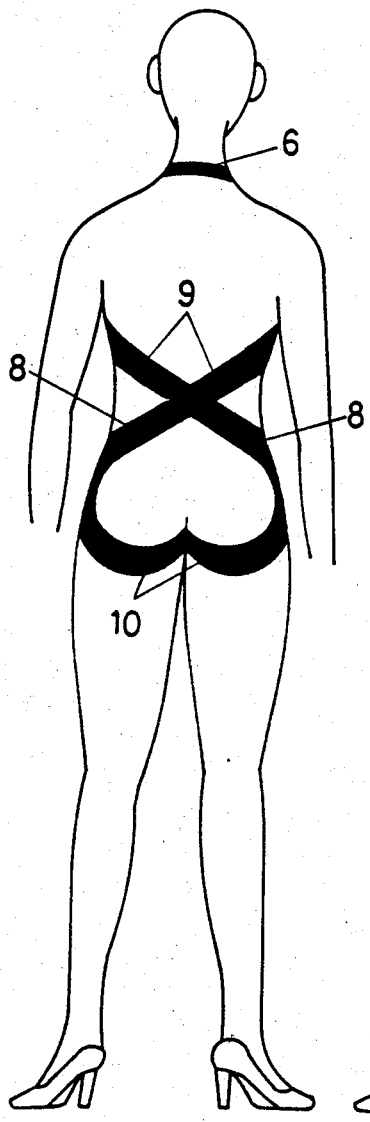
Figure 2:
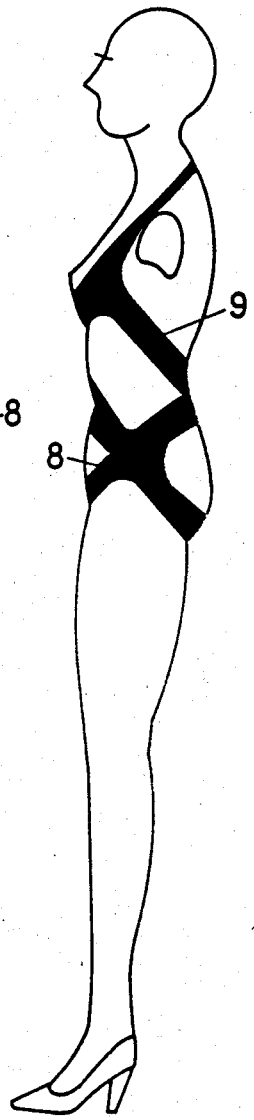
Figure 3:
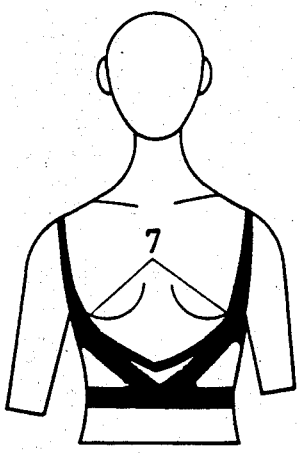
Figure 3:
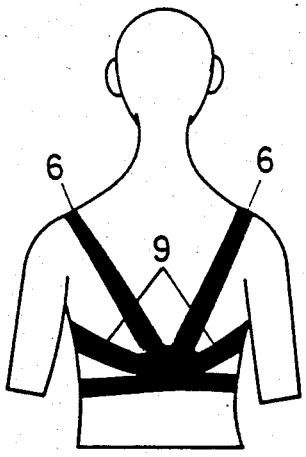
Figure 3:
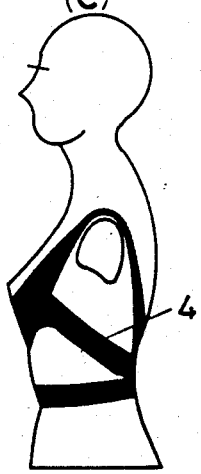
Figure 4:
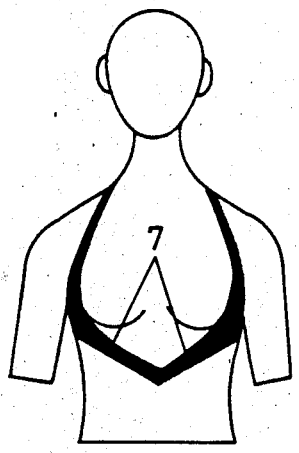
Figure 4:
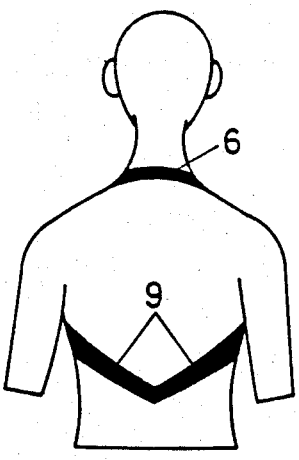
Figure 4:
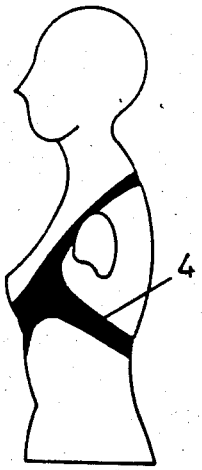
Figure 5:
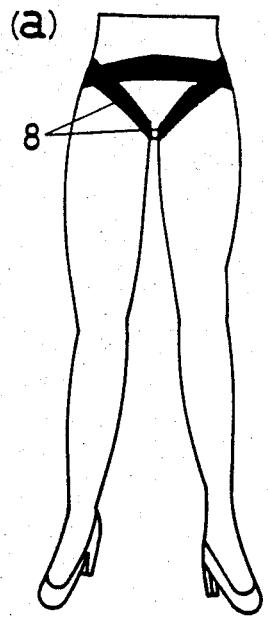
Figure 5:
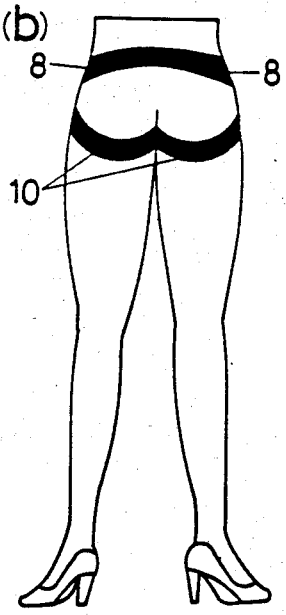
Figure 5:
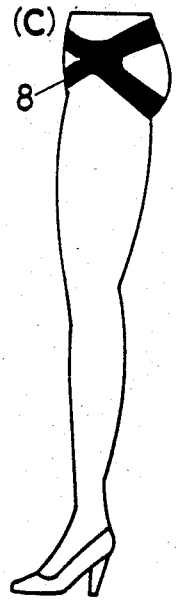
Figure 6:
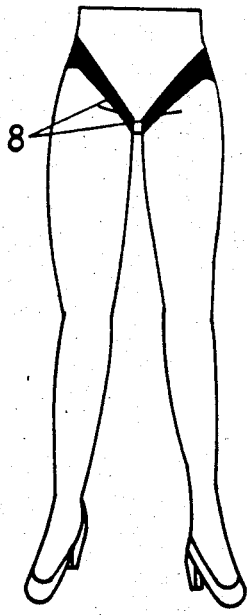
Figure 6:
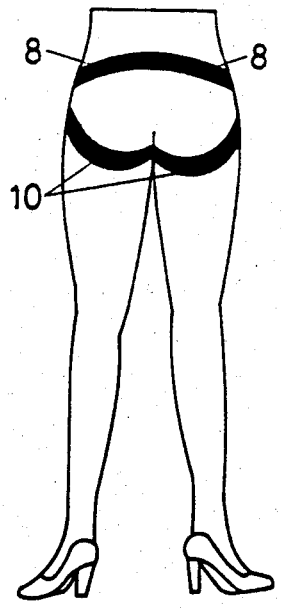
Figure 6:
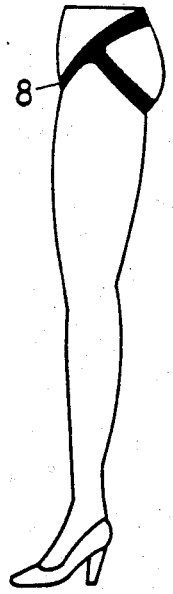
Figure 7:
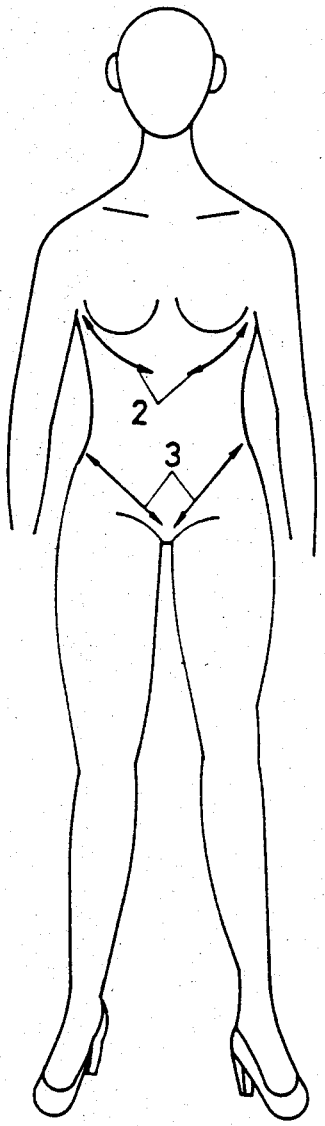
FIG. 7 shows the principal muscles and the direction the muscles work. In each of the above-mentioned figures, (*a*) is a front view, (*b*) a plan view, and (*c*) a side view.
Figure 7:
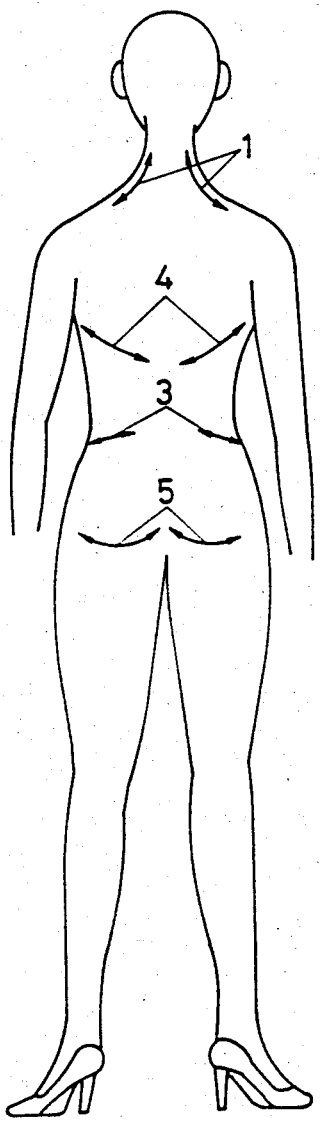
Figure 7:
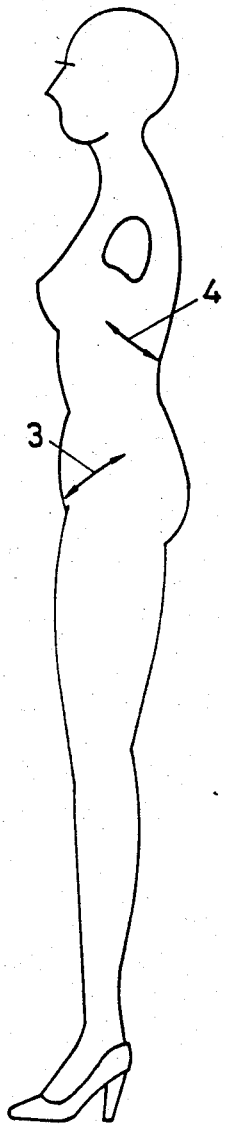

The apparel structure of the present invention will now be illustrated with reference to the FIGS. 1 to 6. The figures all show a stretchable structure portion of the apparel, wherein (*a*) is a front view, (*b*) a rear view, and (*c*) a side view. That structure may be used as an apparel itself or utilized as the structure for fixing the external design of the apparel. In the drawings, the numeral 6 indicates a portion corresponding to musculus trapezius 1, 7 a portion corresponding to musculus pectoralis major 2, 8 a portion corresponding to musculus obliquus externus abdominis 3, 9 a portion corresponding to musculus latissimus dorsi 4, and 10 a portion corresponding to musculus gluteus maximus 5. When the stretchable portion is constructed in such a manner, the object of the present invention is attained.

The structure of a stretchable portion will now be described. The stretchable portion uses a stretchable material such as a power net material or a satin net material, examples of which include "Power Net" (trade name of a product manufactured by Toyobo Co., Ltd.), "Leuka" (trade name of a product manufactured by Asahi Chemical Industry Co., Ltd.), and "Opelon" (trade name of a product manufactured by Toray du Pont K.K.). The material may be cut into a designed pattern, and sewn in a surface cloth or united or bonded thereto as will be described later. In another method, a plurality of materials having different stretchabilities may be combined with desirable stretchabilities in portions necessitating the same. A few pieces of a stretchable material may be superposed if desired. A stretchable structure including a given portion(s) having an arbitrary and necessary stretchability or recoverability may occasionally be constructed by adapting the weaving method, the knitting method, the embroidery method, or the like thereto. Since this method can bring about a feeling of naturalness in wearing, it is effective particulary in making underwear and panty hose.

When a body wearing apparel having such a structure moves, the stretchable portion also moves in accordance with movement of a muscle. Since the fixing mode and the stretchable direction are well adapted to the location and direction of working of a muscle, the movement of the apparel naturally follows the movement of the body with the apparel being always fixed stably on the body. The portion 7 corresponding to musculus pectoralis major exerts a bust lifting effect of transferring the bust in the inward and upward direction. The portion 8 corresponding to the musculus obliqus externus abdominis exerts a shaping-up effect of pressing the abdomen and the flank based on a tensional relationship in the forward and backward as well as leftward and rightward directions of the stretchable portion. The portions 10 corresponding to musculus gluteus maximus exerts a hip lifting effect of lifting upward the whole buttocks including parts of the buttocks close to the crotch which parts are liable to abound with fat. The portion 9 corresponding to musculus latissimus dorsi not only promotes the wearability of the whole apparel on the body, but also exerts an effect of correcting a human body (against stopped shoulder or the like) while at the same time it works as the center of the tensional relation of the whole apparel, the whole fixing mode being so constructed as to be capable of exhibiting a uniformaization phenomenon.

EXAMPLE 2

Figure 8:
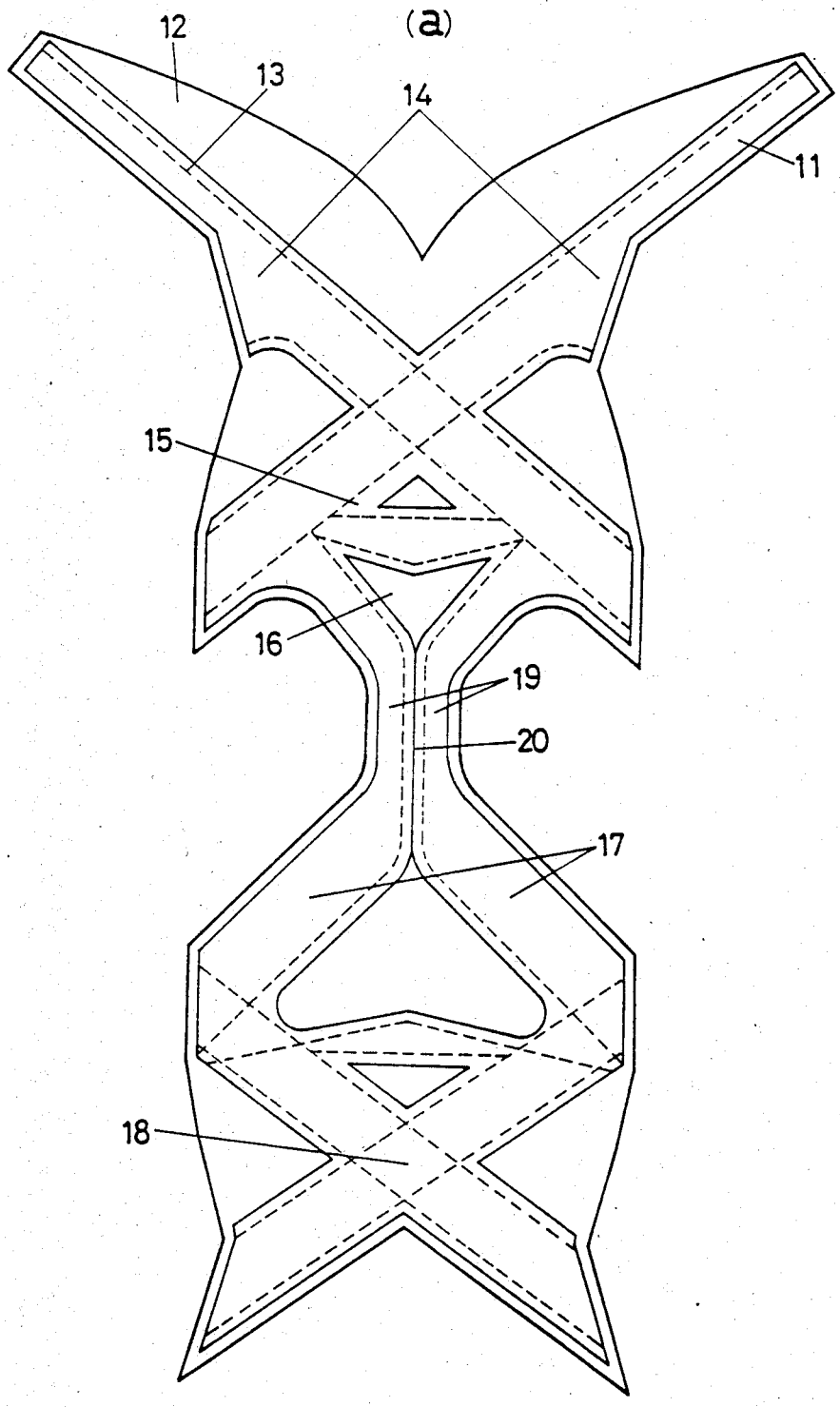
FIG. 8 shows a so-called one piece type including neck-fixing type body suit, leotard, and swimsuit, and includes a developmental view (*a*) of a core material being sewn in a surface cloth, a developmental view (*b*) of only the surface cloth, a developmental view (*c*) of the core material, and a front view (*d*) of the apparel.
Figure 8:
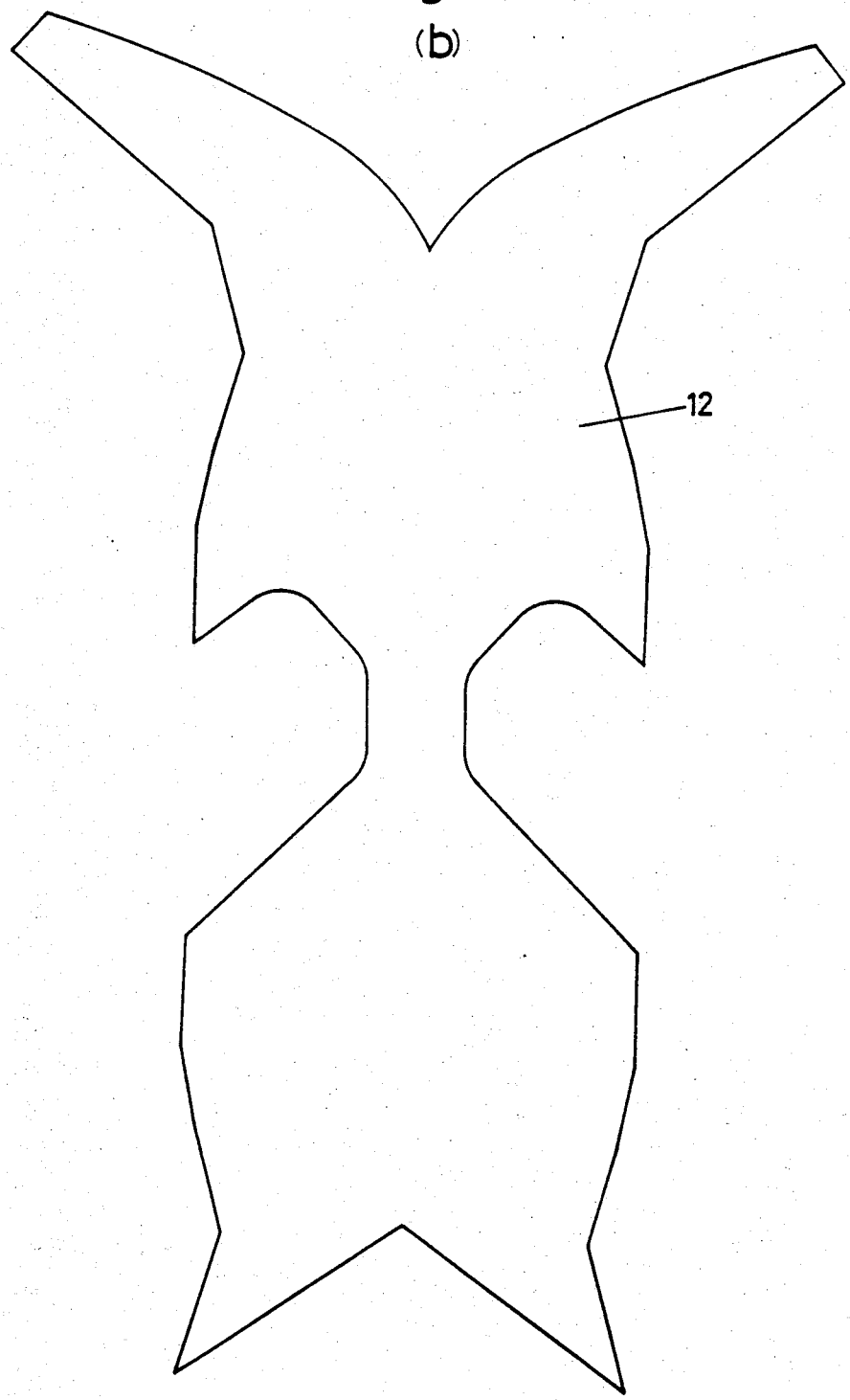
Figure 8:
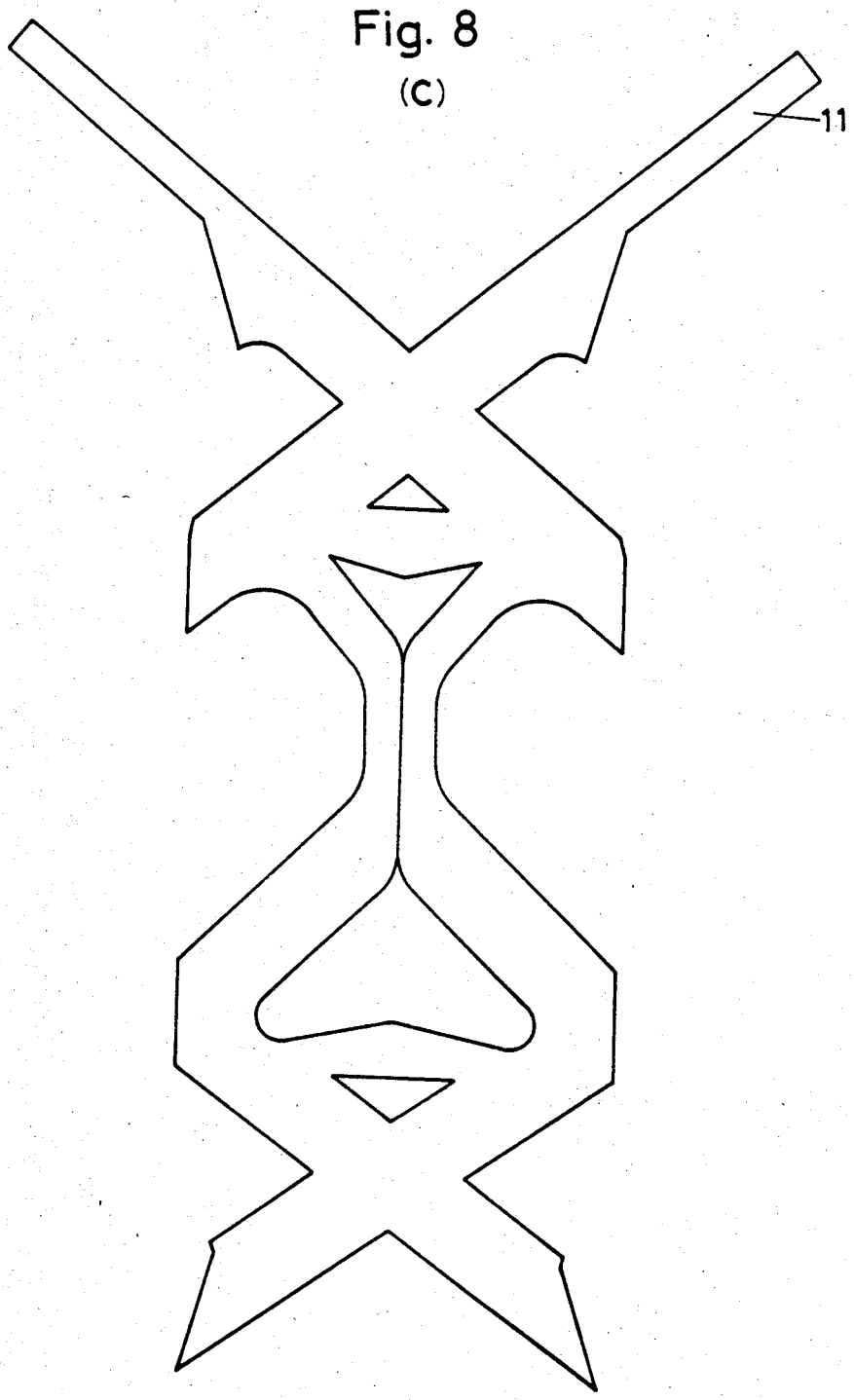
Figure 8:
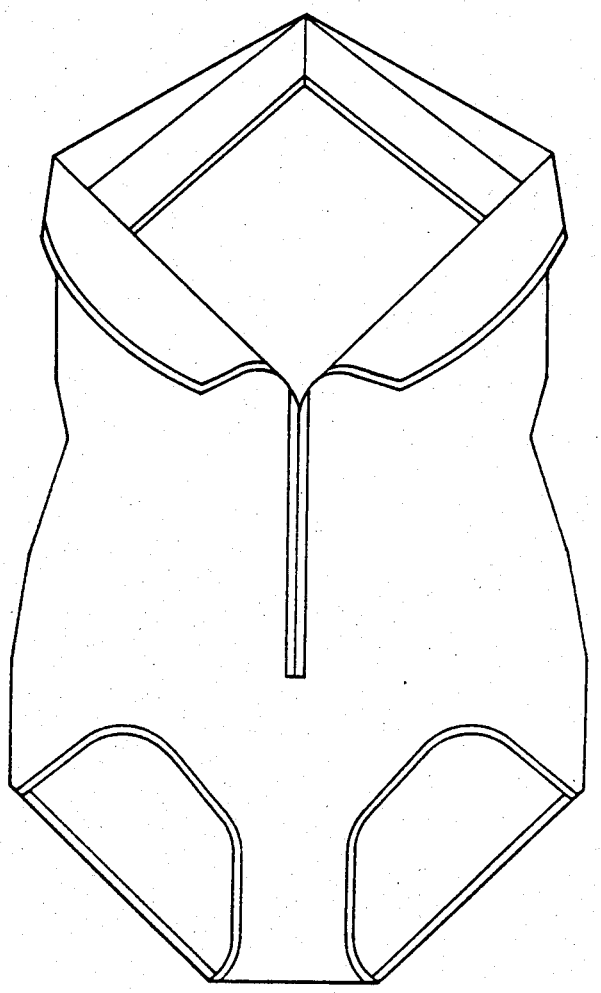

The process for making an apparel according to the present invention will now be described with reference to FIGS. 8(*a*) to (*d*). FIG. 8 shows a so-called one piece type including a body suit, a leotard, and a swimsuit which are continuous along the body in the upward and downward direction. Firstly, a piece of a stretchable cloth is cut into a core material 11 as shown in FIG. 8(*c*). Separately, a surface cloth 12 constituting the external appearance of an apparel is cut as shown in FIG. 8(*b*). The core material 11 is then superposed in an unfolded state on the surface cloth 12 as shown in FIG. 8(*a*), and sew up in the sewing-up portion 13 as indicated by the broken line in a zigzag form by means of a stretchable yarn. Subsequently, the necessary portions are sewn up in a stretchable manner to provide an apparel pattern as shown in FIG. 8(*d*).

The core material 11 is so cut that it runs along muscular portions as mentioned below and/or along the proximities of the muscular portions including musculus pectoralis major 2, musculus gluteus maximus 5, and musculus obliquus externus abdominis 3, and is adapted to the working direction of the muscles when the resulting apparel is worn. The core material 11 as shown in FIG. 8(*a*) has portions 14 corresponding to musculus pectoralis major 2 and supporting the breasts, a portion 15 corresponding to musculus obliquus externus abdominis 3, supporting and pressing the abdomen, and having a cutaway portion 16 with a size adjusted in accordance with the magnitude of pressure to be applied, and portions 17 corresponding to the musculus gluteus maximus 5 and supporting the buttocks (underhips). The portion 18 is a cross part on the side of the back and serves as a point of fitting the apparel to the body, and corresponds to the cotyle mentioned in the medicine of Chinese school so that the core material 11 exerts a slight massage effect on the body when it is worn. The portions 19 are the fixing portions corresponding to the joints of the left and right legs and constituted by the core material separated into the left and right portions by the rift 20 in order to avoid tension in a leg-opened or -seated state and facilitates spread of the surface cloth under the crotch in accordance with the legs when the legs are opened.

A stretchable material similar to the one used as the core material 11 is also used as the surface cloth. In this case, the material of the surface cloth 12 having a higher stretchability than that of the core material 11 is used to allow the core material 11 to work effectively. More specifically, a material more freely and easily stretchable than the core material 11 is used as the surface cloth 12 because the surface cloth 12 must not block the work of the core material 11 from the necessity of the core material 11 running along the muscular portion of the body and supporting the swaying portion. Accordingly, although any arbitrary material can be used as the surface cloth 12 in accordance with the kind of an apparel such as underwear, sportswear, leisure wear, shaping-up correcting wear, or the like, a material more stretchable than the core material 11 must be used. In any case, the stretchabilities of the core material 11 and the surface cloth 12 can be arbitrarily chosen in accordance with the use of the apparel.

Figure 9:
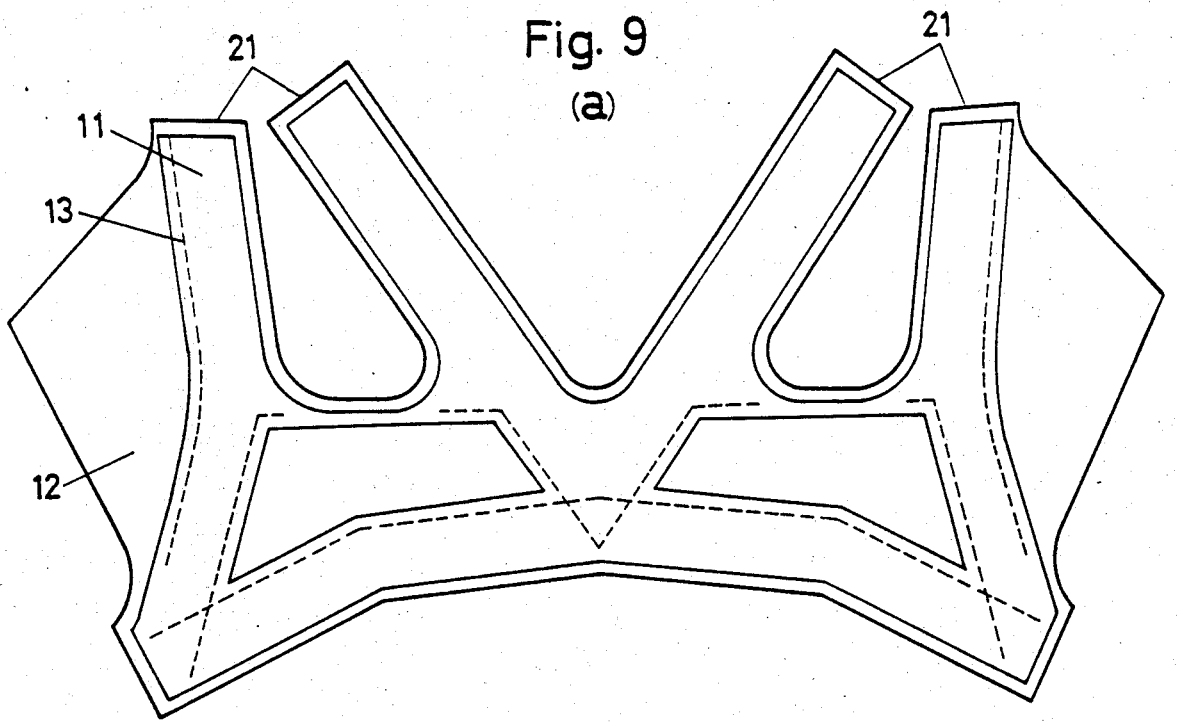
FIG. 9 shows upper clothing item, and includes a developmental view (*a*) of a core material being sewn in a surface cloth, a developmental view (*b*) of only the surface cloth, a developmental view (*c*) of the core material, and a front view (*d*) of the apparel.
Figure 9:
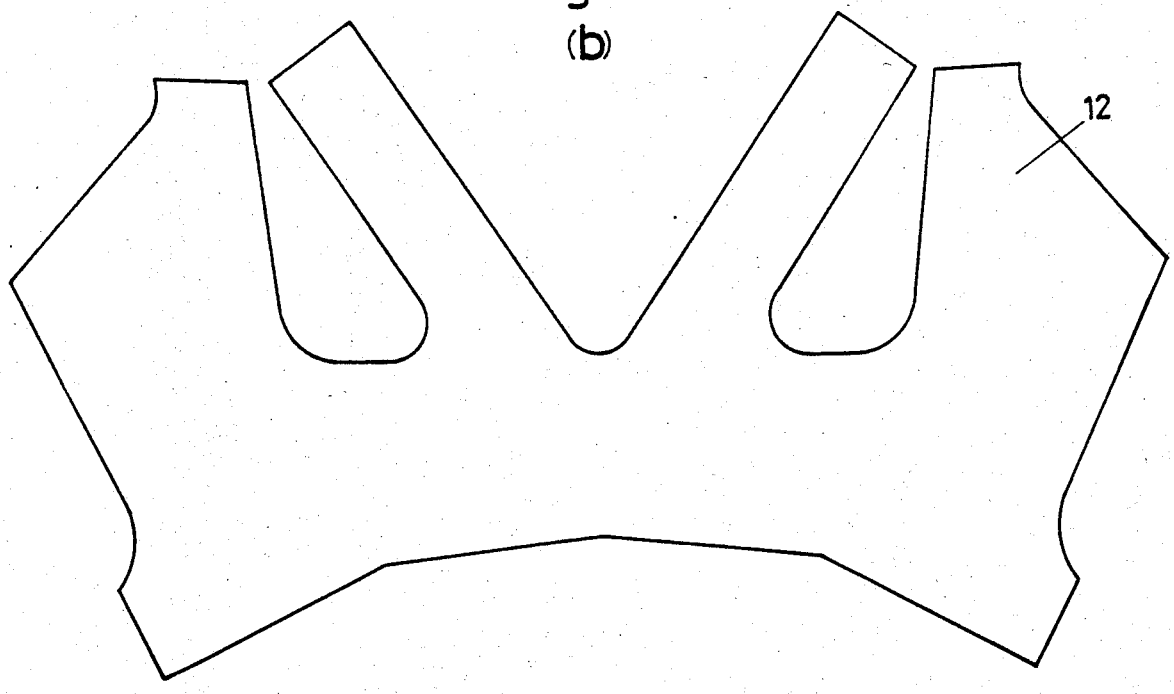
Figure 9:
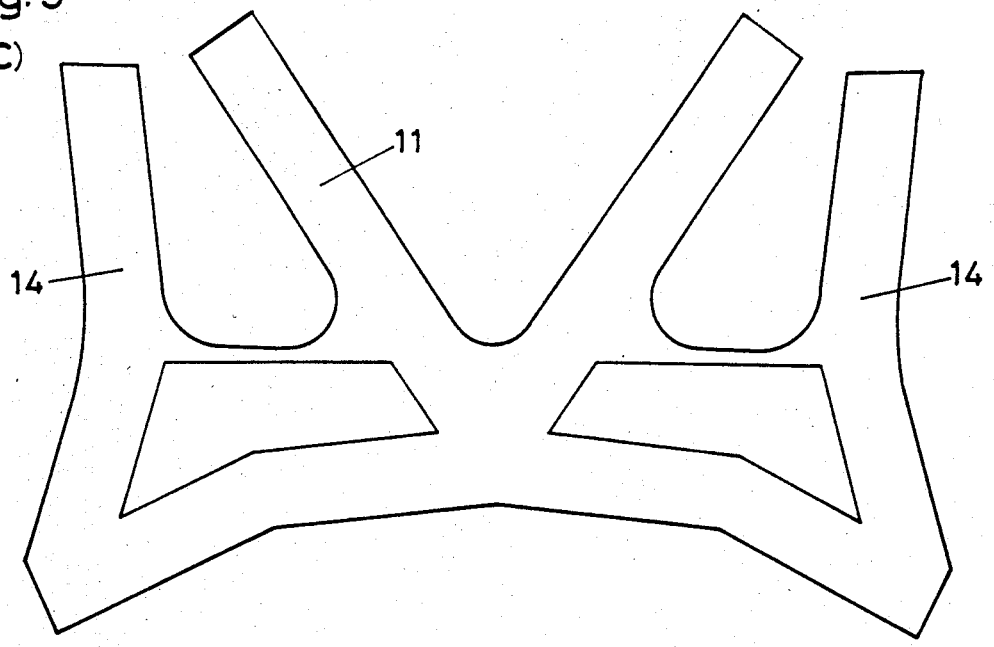
Figure 9:
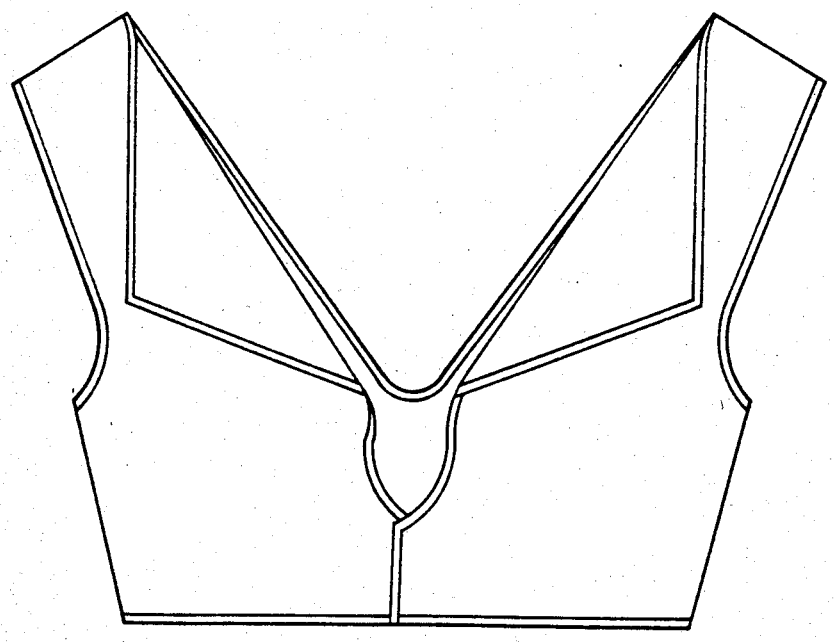

FIGS. 9(*a*) to (*d*) shows an example of a front-fastening type of upper clothes. The core material is cut as shown in FIG. 9(*c*), while the surface cloth 12 is cut as shown in FIG. 9(*b*). They are superposed in a manner as shown in FIG. 9(*a*), sewn up in the sewing-up portion 13 as shown by the broken lines, hemstitched, and sewn up in the shoulder portions 21 to finish them as shown in FIG. 9(*d*).

Figure 10:
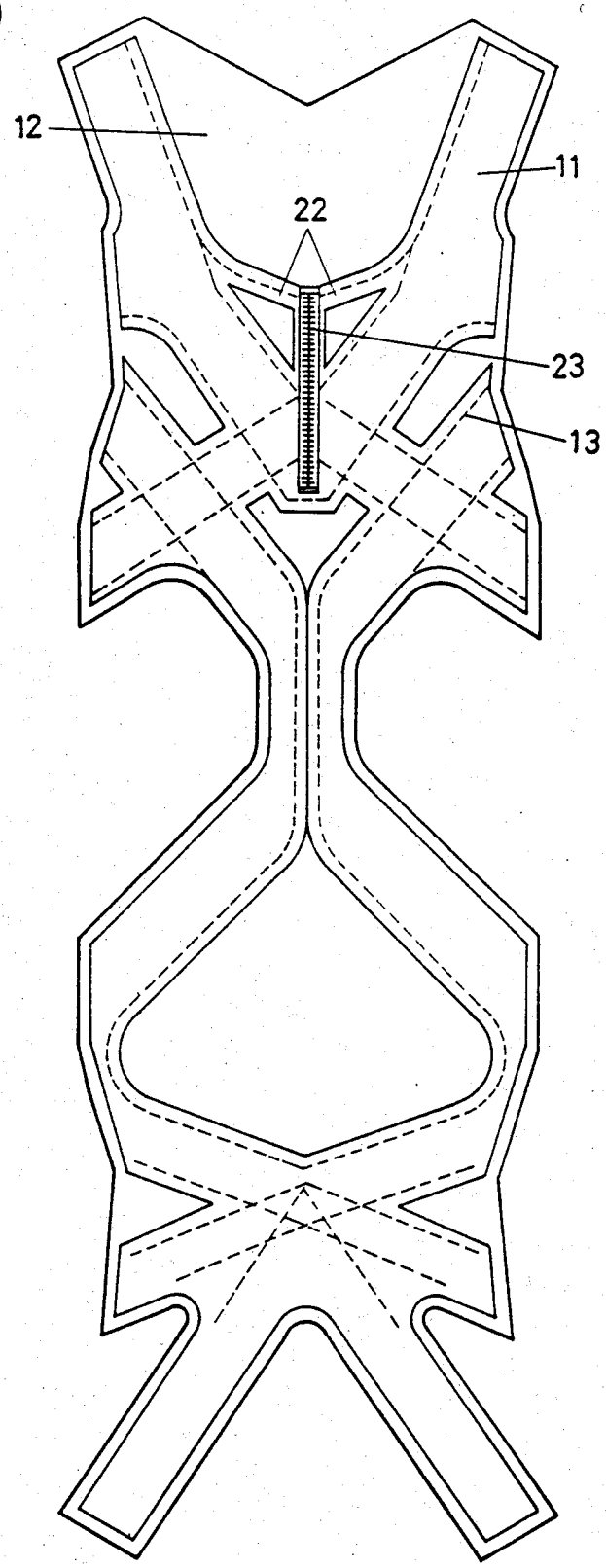
FIG. 10 shows a so-called one piece type including shoulder-fixing type body suit, leotard, and swimsuit, and includes a developmental view (*a*) of a core material being sewn in a surface cloth and a front view (*b*) of the apparel.
Figure 10:
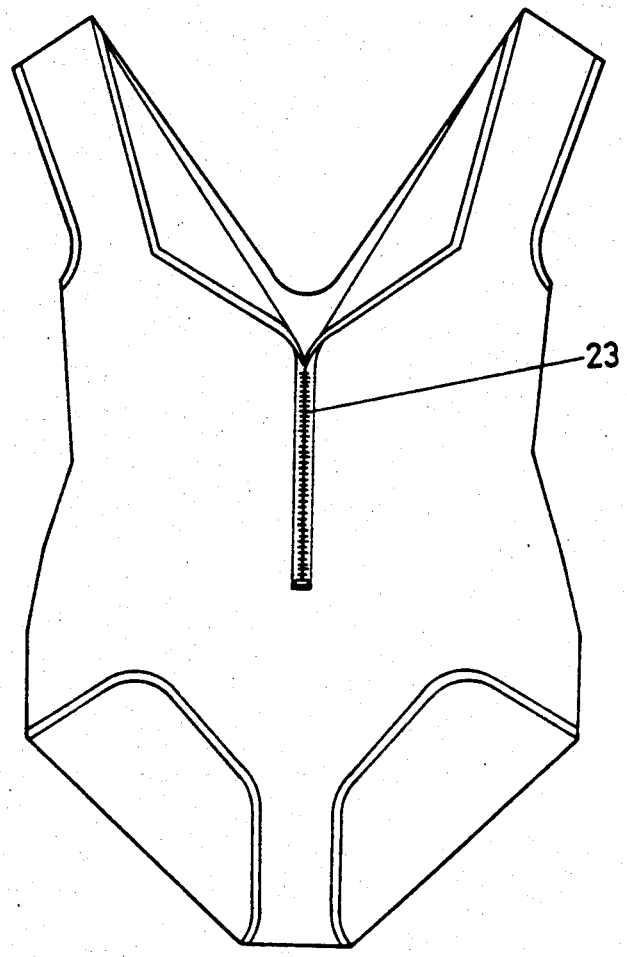
Figure 11:
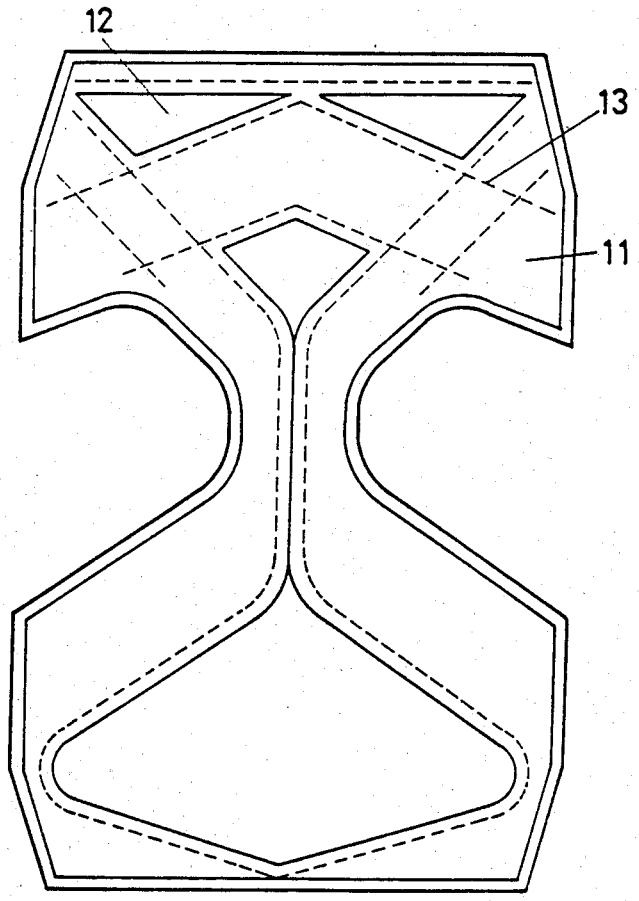
FIG. 11 shows a pants type, and includes a developmental view (*a*) of a core material being sewn in a surface cloth and a front view (*b*) of the apparel.
Figure 11:
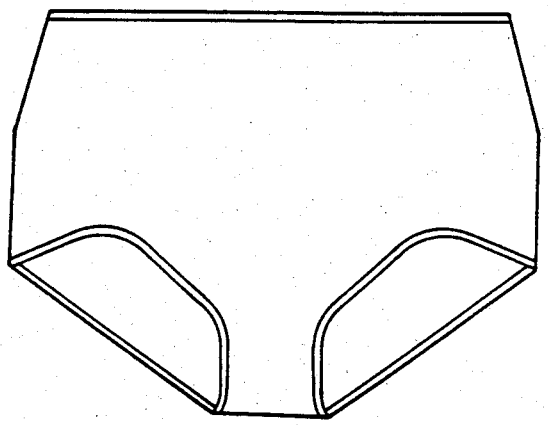
Figure 12:
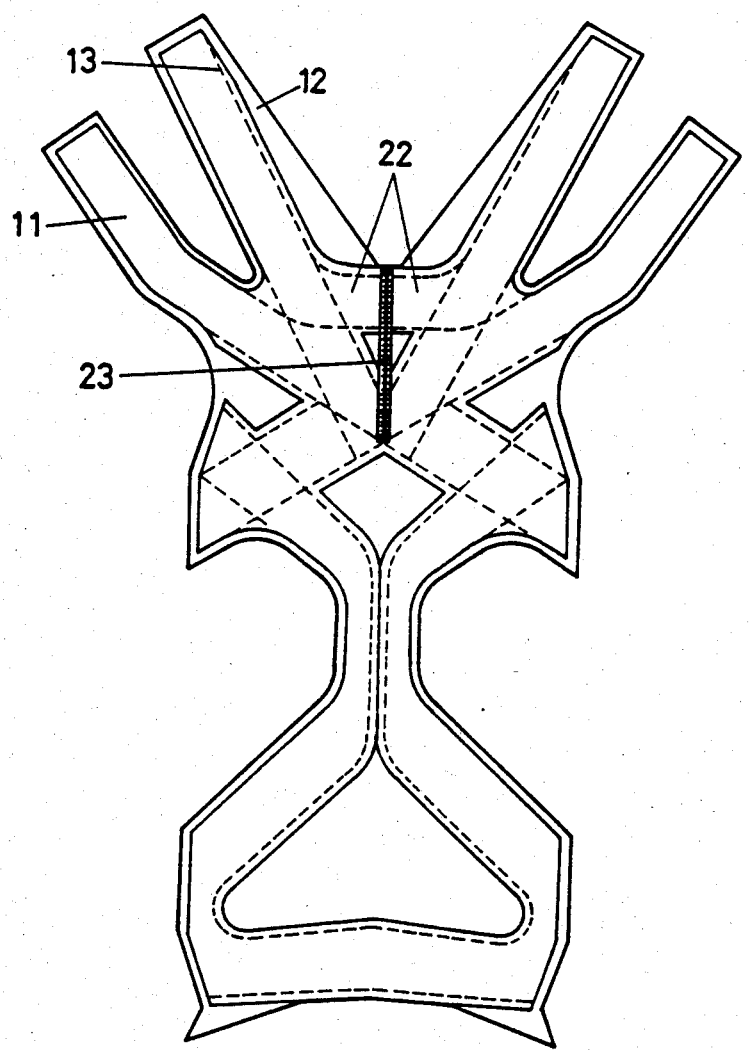
FIG. 12 shows a so-called one piece type including backless type body suit, leotard, and swimsuit, and includes a developmental view (*a*) of a core material being sewn in a surface cloth and a front view (*b*) of the apparel.
Figure 12:
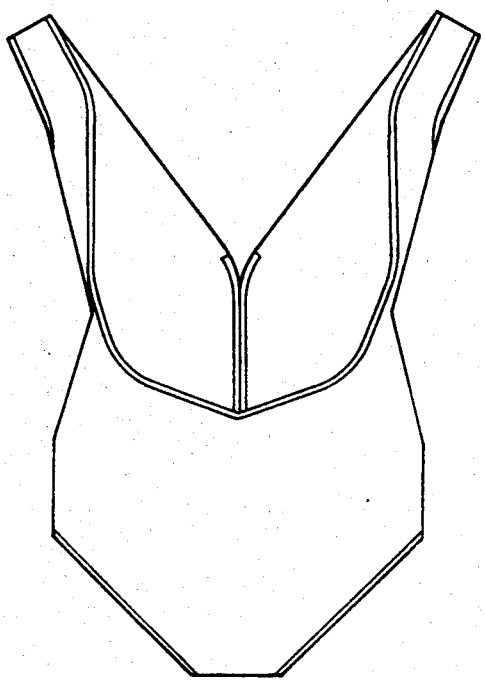

FIGS. 10, 11, and 12 show other examples. FIG. 10 shows a so-called one piece type including a body suit, a leotard, and a swimsuit continuously running in the upward and downward direction. FIG. 11 show a pants type. FIG. 12 show an example of a backless type in which a cross portion 18 on the back side is removed. This form can be applied to an apparel such as a formal dress, which is not adapted to wearing of a brassiere. In those figures, (*a*) shows the state of superposition of the core material 11 and the surface cloth 12, and (*b*) is a view of the finished apparel. In FIGS. 10 and 12(*a*), the numerals 22 indicate assistant portions, while the numerals 23 indicate fasteners. The provision of the assistant portions 22 can effectively serve to support the breasts, while the supporting power can be controlled by controlling the degree of fastening of the fastener 23.

INDUSTRIAL APPLICABILITY

As described above, since the apparel is constructed to be so stretchable in accordance with the working direction of the body, the apparel can be naturally adapted to the movement of the body. Thus, the apparel is very comfortable and has excellent shaping-up effect. This apparel structure can be applied to not only sportswear and shaping-up wear but also to various kinds of apparel. Since the apparel itself has a shaping-up effect, wearing of underwear for the correction becomes unnecessary.

According to the process for making an apparel of the present invention, since the core material is continuously cut into a pattern of the core material from a piece of cloth and is sewn in the surface cloth in an unfolded superimposed state, the work of sewing the core material in the surface cloth is simple. Further, since the core material is cut in accordance with the pattern of the surface cloth, an apparel in which the core material is uniformly sewn in the surface cloth with neither stretching nor contraction can be manufactured in a simple manner.

What is claimed is:

1. Apparel adapted to be worn by a person comprising a one-piece core material of stretchable cloth, said core material being in the form of a plurality of jointed band portions adapted to be worn by a person and having a front and rear side along with two lateral sides, one of said band portions being a musculus trapezius first band portion in the form of two loops each extending from the front side to the rear side, another of said band portions being a musculus pectoralis second portion on the front side and extending between said two loops, another of said band portions being a musculus latissimus dorsi third band portion on each of said lateral sides and extending between the front side of each loop and the respective rear side of each loop, another of said band portions being a musculus obliquus externus abdominis fourth band portion having two front sections on said front side and two side-rear sections on said two lateral sides and said rear side, said two front sections being joined at a juncture, said two side-rear sections extending to said loops at said rear side, another of said band portions being a gluteus maximus fifth band portion having two rear sections on said rear side and two side sections on said lateral sides, said two rear sections being joined to said juncture, said two side sections being joined to said fourth band portion, and a sixth band portion on said front side joining said first and said fourth band portions.

2. Apparel according to claim 1 further comprising surface cloth material, and securing means securing said surface cloth material to said core material to form an item of clothing.

3. Apparel according to claim 2, wherein said surface cloth material comprises a stretchable material having a stretchability which is greater than the stretchability of said core material.

4. Apparel according to claim 2, wherein said securing means comprises sewn stretchable yarn.

5. Apparel adapted to be worn by a person comprising a one-piece core material of stretchable cloth, said core material being in the form of a plurality of joined band portions adapted to be worn by a person and having a front and rear side along with two lateral sides, one of said band portions being a musculus trapezius first band portion in the form of a loop extending from the front side and looping over the rear side, another of said band portions being a musculus pectoralis section portion on the front side and extending from said loop, another of said band portions being a musculus latissumus dorsi third band portion on each of said lateral sides and extending from the front side of said loop to a first juncture at said rear side, another of said band portions being a musculus obliquus externus abdominis fourth band portion having two front sections on said front side and two side-rear sections on said two lateral sides and said rear side, said two front sections being joined at a second juncture, said two side-rear sections extending to said first juncture at said rear side, another of said band portions being a gluteus maximus fifth band portion having two rear sections on said rear side and two side sections on said lateral sides, said two rear sections being joined to said second juncture, said two side sections being joined to said fourth band portion, and a sixth band portion on said front side joining said first and said fourth band portions.

6. Apparel according to claim 5 further comprising surface cloth material, and securing means securing said surface cloth material to said core material to form an item of clothing.

7. Apparel according to claim 6, wherein said surface cloth material comprises a stretchable material having a stretchability which is greater than the stretchability of said core material.

8. Apparel according to claim 6, wherein said securing means comprises sewn stretchable yarn.

9. Apparel adapted to be worn by a person comprising a one-piece core material of stretchable cloth, said core material being in the form of a plurality of joined band portions adapted to be worn by a person and having a front and rear side along with two lateral sides, one of said band portions being a musculus trapezius first band portion in the form of two loops extending from the front side to the rear side, another of said band portions being a musculus pectoralis second portion on the front side and extending between said two loops, another of said band portions being a musculus latissimus dorsi third band portion on each of said lateral sides and extending between the front side of each loop and the respective rear side of each loop, and one of said band portions being a fourth band portion encircling said front and rear sides and said two lateral sides, said fourth band portion being connected to said front portion at said front and rear sides.

10. Apparel according to claim 9 further comprising surface cloth material, and securing means securing said surface cloth material to said core material to form an item of clothing.

11. Apparel according to claim 10, wherein said surface cloth material comprises a stretchable material having a stretchability which is greater than the stretchability of said core material.

12. Apparel according to claim 10, wherein said securing means comprises sewn stretchable yarn.

13. Apparel adapted to be worn by a person comprising a one-piece core material of stretchable cloth, said core material being in the form of a plurality of joined band portions adapted to be worn by a person and having a front and rear side along with two lateral sides, one of said band portions being a musculus trapezius first band portion in the form of a loop extending from the front side and looping over the rear side, said loop having two front sections, another of said band portions being a musculus pectoralis second portion on the front side and extending between said front sections of said loop, another of said band portion being a musculus latissimus dorsi third band portion on each of said lateral sides and extending from said front section of said loop and extending about said rear side.

14. Apparel adapted to be worn by a person comprising a one-piece core material of stretchable cloth, said core material being in the form of a plurality of joined band portions adapted to be worn by a person and having a front and rear side along with two lateral sides, one of said band portions being a musculus obliquus externus abdominis first band portion having two front sections on said front side and a side-rear section on said two lateral sides and on said rear side, said two front sections being joined at a juncture, another of said band portions being a gluteus maximus second band portion having two rear sections on said rear side and two side sections on said lateral sides, said two rear sections being joined to said juncture, said two side sections being joined to said first band portion.

15. Apparel according to claim 14 further comprising a third band portion on said front side extending between said two front sections of said first portion.

16. Apparel adapted to be worn by a person comprising a one-piece core material of stretchable cloth, said core material having a musculus trapezius first portion in the form of two loops which are adapted to extend over the shoulders of said person and pass over the musculus trapezius of said person, each of said loops having a front section and a rear section, said core material haing a musculus pectoralis second portion extending generally transversely between said front sections of each loop and adapted to pass over the musculus pectoralis major in the front of said person, said core material having a musculus latissimus dorsi third portion extending from said front sections of said loops and adapted to pass over the musculus latissimus dorsi at the sides of said person and extend to the back of said person to be joined to said rear sections of said loops at a juncture, said core material having a musculus obliquus externus abdominis fourth portion which extends generally from said juncture and adapted to pass over the musculus obliquus externus abdominis at the front and sides of said person, said core material having a musculus gluteus maximus fifth portion extending from said fourth portion and adapted to pass over the musculus gluteus maximus on the back of said person, said core material further having a sixth portion extending between said first portion and said fourth portion such that siad first to sixth portions are formed from a single piece of said stretchable cloth and biasingly passes over the muscles of said person.

17. Apparel adapted to be worn by a person comprising a one-piece core material of stretchable cloth, said core material having a musculus trapezius first portion in the form of a loop which is adapted to extend about the neck and over the shoulders of said person and to pass over the musculus trapezius of said person, said loop having front end sections, said core material having a musculus pectoralis second portion extending generally transversely from said front end sections of said loop and adapted to pass over the musculus pectoralis major in the front of said said person, said core material having a musculus latissimus dorsi third portion extending from said front end sections of said loop and adapted to pass over the musculus latissimus dorsi at the sides of said person and extend to the back of said person to be joined at a juncture, said core material having a musculus obliquus externus abdominis fourth portion which extends from said juncture and which is adapted to pass over the musculus obliquus externus abdominis at the front and sides of said person, said core material having a musculus gluteus maximus fifth portion extending from said fourth portion and adapted to pass over the musculus gluteus maximus on the back side of said person, said core material further having a sixth portion extending between said first portion and said fourth portion such that said first to sixth portions are formed from a single piece of said stretchable cloth and biasingly passes over the muscles of said person.

* * * * *